US007707955B1

(12) United States Patent
Johns, Jr. et al.

(10) Patent No.: US 7,707,955 B1
(45) Date of Patent: May 4, 2010

(54) TRANSOM PLATFORM LIFTING APPARATUS AND METHOD

(75) Inventors: Carl E. Johns, Jr., Cocoa, FL (US); Stephen G. Johns, Cocoa, FL (US)

(73) Assignee: Sealift, Inc., Cocoa, FL (US)

( * ) Notice: Subject to any disclaimer, the term of this patent is extended or adjusted under 35 U.S.C. 154(b) by 0 days.

(21) Appl. No.: 12/180,625

(22) Filed: Jul. 28, 2008

Related U.S. Application Data

(60) Provisional application No. 60/954,467, filed on Aug. 7, 2007, provisional application No. 60/957,041, filed on Aug. 21, 2007, provisional application No. 60/981,153, filed on Oct. 19, 2007.

(51) Int. Cl.
*B63B 35/40* (2006.01)

(52) U.S. Cl. ..... 114/259; 114/44; 114/369; 405/3

(58) Field of Classification Search ..... 114/44, 114/45, 258, 259, 260, 365, 368, 369, 373; 405/1, 2, 3, 4, 5, 6, 7; 280/414.1; 414/678, 414/679

See application file for complete search history.

(56) References Cited

U.S. PATENT DOCUMENTS

| | | | | |
|---|---|---|---|---|
| 582,069 | A | 5/1897 | Leslie | |
| 789,813 | A | 5/1905 | Longley | |
| 1,297,276 | A * | 3/1919 | Waddington | 114/373 |
| 2,013,542 | A | 9/1935 | Nordmark | |
| 2,185,083 | A | 12/1939 | Horton | |
| 2,761,571 | A | 9/1956 | Adams | |
| 2,805,782 | A * | 9/1957 | Jester | 414/678 |
| 3,021,965 | A | 2/1962 | Harvey | |
| 3,143,991 | A | 8/1964 | Anderson | |
| 3,244,300 | A | 4/1966 | Erdody | |
| 3,653,715 | A | 4/1972 | Drabert et al. | |
| 3,716,230 | A | 2/1973 | Mark | |
| 3,782,717 | A | 1/1974 | Berlin | |
| 3,857,127 | A | 12/1974 | Henderickson | |
| 4,271,553 | A | 6/1981 | Korsvik | |
| 4,565,343 | A | 1/1986 | Lake, Jr. et al. | |
| 4,627,377 | A | 12/1986 | Zoonens | |

(Continued)

FOREIGN PATENT DOCUMENTS

| | | |
|---|---|---|
| DE | 19963057 | 12/2000 |

(Continued)

*Primary Examiner*—Lars A Olson
(74) *Attorney, Agent, or Firm*—Allen, Dyer, Doppelt, Milbrath & Gilchrist, P.A.

(57) ABSTRACT

A lifting apparatus includes a lift arm for carrying a platform or cradle and is pivotally attached to a base for movement between lowered and raised positions. A crank arm is pivotal with the base and a connector arm is pivotal with the lift arm. The crank arm and connector arm are pivotally connected to each other for rotation about a common pivot axis. Rotation of the crank arm by an actuator moves the crank arm and connector arm combination through a top dead center alignment a lowered over center alignment with the lift arm movable from the lowered position to the raised position during operating positions of the apparatus, and to a raised over center alignments with limited movement of the lift arm in the raised position for providing a locking position of the apparatus thus eliminating a need for typical additional locking mechanism.

23 Claims, 10 Drawing Sheets

U.S. PATENT DOCUMENTS

| | | | |
|---|---|---|---|
| 4,641,596 | A | 2/1987 | Reprogle et al. |
| 4,641,996 | A | 2/1987 | Seal |
| 4,861,299 | A | 8/1989 | Ueberschaer |
| 4,878,450 | A | 11/1989 | Schmidt, Jr. |
| 4,895,479 | A | 1/1990 | Michaelsen et al. |
| 4,900,187 | A | 2/1990 | Uchida et al. |
| 4,934,647 | A | 6/1990 | Edwards |
| 4,964,358 | A | 10/1990 | Sandrow |
| 5,022,707 | A | 6/1991 | Beauvais et al. |
| 5,054,739 | A | 10/1991 | Wallin |
| 5,090,841 | A | 2/1992 | Penick, Jr. et al. |
| 5,133,275 | A | 7/1992 | Maurizio |
| 5,170,742 | A | 12/1992 | Roskelley |
| 5,184,913 | A | 2/1993 | Meriwether |
| 5,184,914 | A | 2/1993 | Basta |
| 5,193,479 | A | 3/1993 | Bielefeld |
| 5,232,426 | A | 8/1993 | Van Straaten |
| 5,445,353 | A | 8/1995 | Sakamoto |
| 5,483,912 | A | 1/1996 | Thomas |
| 5,522,341 | A | 6/1996 | Green |
| 5,544,606 | A | 8/1996 | Schmidt, Jr. |
| 5,584,535 | A | 12/1996 | Jacobson et al. |
| 5,613,462 | A | 3/1997 | Schwartz |
| 5,622,348 | A | 4/1997 | Stechly |
| 5,664,516 | A | 9/1997 | Breeden |
| 5,665,042 | A | 9/1997 | Breaux |
| 5,669,324 | A | 9/1997 | Muir |
| 5,690,045 | A | 11/1997 | Gauthier |
| 5,884,885 | A | 3/1999 | Schmidt, Jr. |
| 5,919,000 | A | 7/1999 | Unkle |
| 6,003,463 | A | 12/1999 | Giesler |
| 6,030,324 | A | 2/2000 | McBride |
| 6,047,659 | A | 4/2000 | Schmidt, Jr. |
| 6,152,065 | A | 11/2000 | Gronstrand |
| 6,164,893 | A | 12/2000 | Glomot et al. |
| 6,178,914 | B1 | 1/2001 | Axelsson |
| 6,217,053 | B1 | 4/2001 | Forsythe et al. |
| 6,321,678 | B1 | 11/2001 | Skulnick |
| 6,327,992 | B1 | 12/2001 | Martin |
| 6,474,256 | B1 | 11/2002 | Vogel |
| 6,502,525 | B2 | 1/2003 | Burke |
| 6,554,533 | B2 | 4/2003 | Godbersen |
| 6,585,211 | B1 | 7/2003 | Hageman et al. |
| 6,591,770 | B1 | 7/2003 | Blackmore |
| 6,598,549 | B1 | 7/2003 | Voegeli |
| 6,782,842 | B1 | 8/2004 | Alvord |
| 6,786,170 | B2 | 9/2004 | Towbridge |
| 6,883,454 | B2 | 4/2005 | Blackmore |
| 6,953,003 | B1 | 10/2005 | Mulhern |
| 7,293,521 | B1 | 11/2007 | Johns, Jr. et al. |
| 7,377,720 | B2 * | 5/2008 | Stewart ..... 405/3 |
| 2002/0132537 | A1 | 9/2002 | Hey |
| 2003/0099528 | A1 | 5/2003 | Hageman et al. |
| 2003/0192466 | A1 | 10/2003 | Trowbridge |
| 2005/0058508 | A1 | 3/2005 | Way |
| 2006/0219149 | A1 | 10/2006 | Giannasca |
| 2007/0041788 | A1 | 2/2007 | Stewart |

FOREIGN PATENT DOCUMENTS

| | | |
|---|---|---|
| JP | 09263292 | 10/1997 |
| JP | 2001128793 | 5/2001 |
| JP | 2005342263 | 12/2005 |
| WO | 2004022421 | 3/2004 |

* cited by examiner

TRANSOM PLATFORM LIFTING APPARATUS AND METHOD

CROSS-REFERENCE TO RELATED APPLICATION

This application claims the benefit of U.S. Provisional Applications Ser. No. 60/954,467 filed Aug. 7, 2007 for "Lifting Apparatus and Method," Ser. No. 60/957,041 filed Aug. 21, 2007 for "Transom Platform and Dinghy Chock Lifting Apparatus and Method," and Ser. No. 60/981,153 filed Oct. 19, 2007 for "Transom Platform and Dinghy Chock Lifting Apparatus and Method," the disclosures of which are hereby incorporated by reference herein in their entirety, and all commonly owned.

FIELD OF INVENTION

The present invention generally relates to mechanical lifting devices and more particularly to lifts useful as a marine accessory.

BACKGROUND

While dock mounted and transom mounted davits and lifts are well known, improvements have been developed throughout the years as described in U.S. Pat. No. 7,293,521 to Johns, JR. et al. for "Hydraulic Transom Lift," the disclosure of which is herein incorporated by reference in its entirety. As described in the Johns '521 patent, a transom mounted lift assembly includes a lift arm operable with an actuator for rotating the lift arm. A lift arm extension member has a cradle attached for carrying a watercraft such as a dinghy. Once the watercraft is lifted to a storage position, the lift assembly is locked into position using a latch having a hook rotated onto a latch pin. Both the lift actuator and the latch actuator are driven by a hydraulic power pack. One need for the locking and thus the latch results from typically slow pressure drops in the hydraulic lines feeding fluid and pressure to the actuators. Such need to secure the lift assembly in a stored position is well known in the art, as further illustrated with reference to U.S. Pat. No. 6,327,992 to Martin for "Hydraulic Lift for Small Watercraft Mounted to a Boat Transom," wherein a locking cylinder actuates a plate having a hook for securing the lifting apparatus in a stored position. The present invention is directed to improving a lift and avoiding the need for added equipment such as the locking latch, by way of example.

SUMMARY

The present invention may be described as a lifting apparatus comprising a base and a lift arm having a proximal end and a distal end, the proximal end pivotally attached to the base for a generally vertical rotation of the lift arm about a lift arm proximal pivot axis, wherein the lift arm distal end is moveable between a lowered position and a raised position. A crank arm having a proximal end and a distal end may include the proximal end pivotally attached to the base for rotation of the crank arm about a crank arm proximal pivot axis. A connector arm having a proximal end and a distal end may include the proximal end pivotally attached to the lift arm for rotation about a connector arm proximal pivot axis, and the distal end pivotally attached to the distal end of the crank arm for rotation about a common connector arm to crank arm distal pivot axis. An actuator is operable with at least one of the crank arm and the connector arm for rotational movement thereof.

One embodiment may comprise the rotation of the connector arm and the crank arm such that in combination the connector arm and the crank arm are movable from a top dead center alignment having the common connector arm to crank arm distal pivot axis in a straight line alignment with both the connector arm proximal pivot axis and the crank arm proximal pivot axis, and wherein the actuator causes movement of the crank arm and the connector arm from the top dead center alignment to lowered over center alignments with the lift arm movable from the lowered position to the raised position during operating positions of the apparatus, to raised over center alignments with limited movement of the lift arm in the raised position during a locking position of the apparatus. Yet further, a stop may be positioned for limiting a range of movement of the lift arm during the raised over center alignment of the connector arm and the crank arm.

Associated methods may comprise operating the actuator for rotating the crank arm in a counter clockwise direction, wherein the counter clockwise rotation of the crank arm results in a lowering of the lift arm distal end to a lowered position of the lifting apparatus, and operating the actuator for rotating the crank arm in a clockwise direction, wherein the clockwise rotation of the crank arm results in a raising of the lift arm distal end to a raised position of the lifting apparatus. The crank arm and the connector arm in combination may be rotated through a top dead center alignment, wherein a rotation axis of the pivot pin assembly, a common connector arm to crank arm distal pivot axis, is in a straight line alignment with both the connector arm proximal pivot axis and the crank arm proximal pivot axis, to a raised over center alignment in the raised position, wherein the raised over center alignment results in the pivot pin assembly hitting a stop and thus preventing further clockwise rotation of the crank arm and thus providing a locking position of the apparatus. Yet further, the crank arm may be rotated in a counter clockwise direction for moving the apparatus from the over center position of the locking position through the top dead center alignment, wherein the rotation axis of the pivot pin assembly moves beyond the straight line alignment to a lowered over center alignment permits movement of the lift arm distal end to the lowered position.

Embodiments of the present invention directed to a lifting apparatus having a mechanical locking feature are herein described by way of example and may include a lift arms pivotally attached to a base plate, which base plate may be mounted to a transom or supporting structure such as a dock. An actuator such as a hydraulic piston may be operable with linking elements to raise ad lower the lift arm. One linking element includes a crank arm and connector arm operable with the actuator. Operation of the lift arm from a lowermost position through intermediate positions and to an upper position provides the lifting function. As the actuator operates to pull the crank arm upward through the action of the piston rod pulling from the piston rod pivot axis, the connector arm pivot rod is moved beyond an axis or plane for which the connector arm longitudinal axis and the crank arm longitudinal axis are coincident or within the plane. Such an action causes the connector arm pivot axis rod to be biased against the cylinder wall (or alternatively a separate stop element) under gravitational force from the weight of the lift arm. As a result, the hydraulic pressure in the lines feeding the actuator may be released allowing the linking elements to be held in a stored position. When it is time to lower the lift arm, hydraulic pressure is provided to the actuator for moving the piston rod outward and driving the crank arm to a lowering position. A platform may be attached to the lift arm with a leveling arm cooperating with the lift arm to maintain the platform in a generally horizontal position throughout its movement. Yet further, a chock assembly may be carried by the platform.

BRIEF DESCRIPTION OF DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS

The present invention will now be described more fully with reference to the accompanying drawings in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
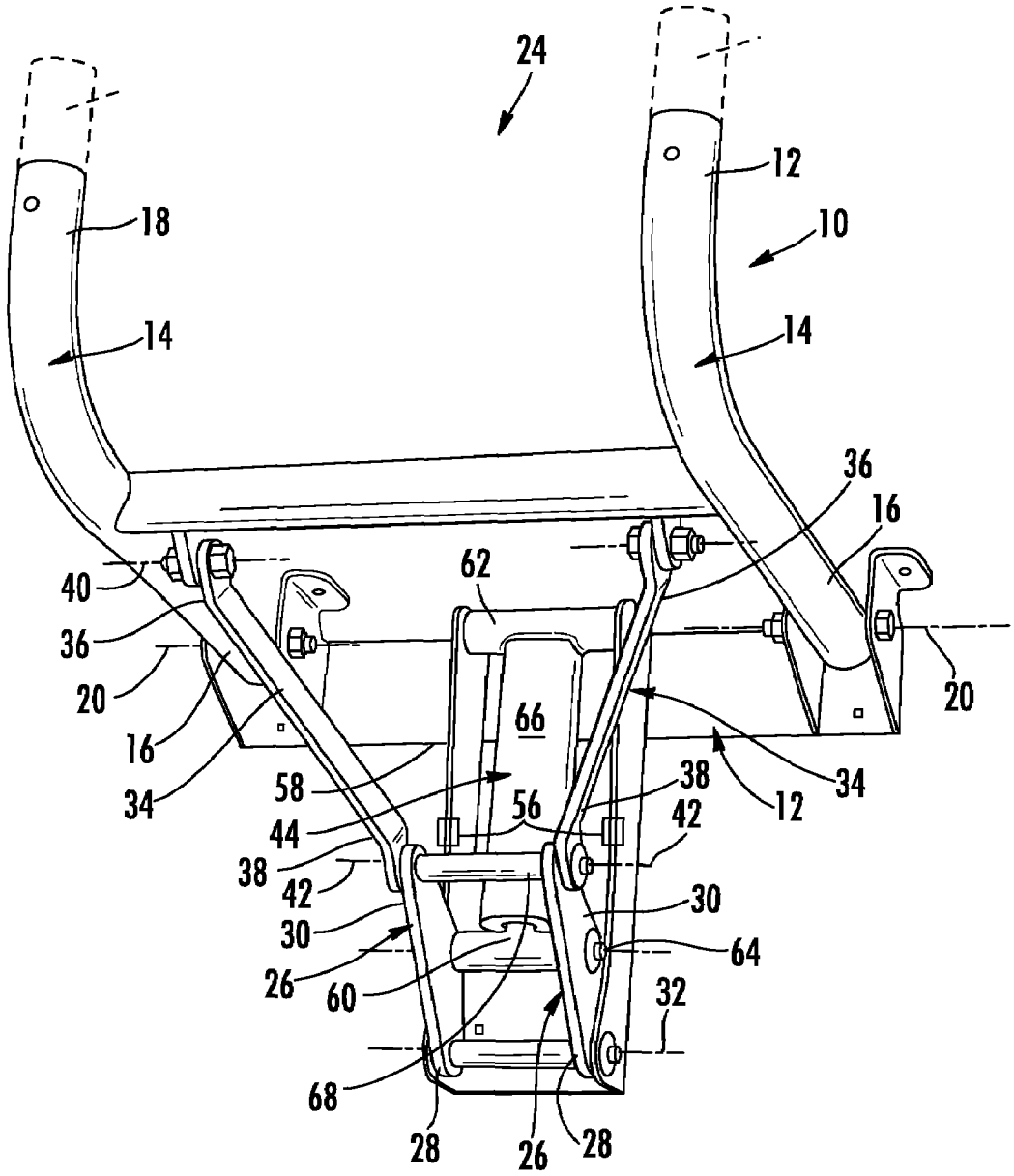
FIG. 1 is a perspective view of one embodiment of a lifting apparatus in keeping with the teachings of the present invention.
Figure 2:
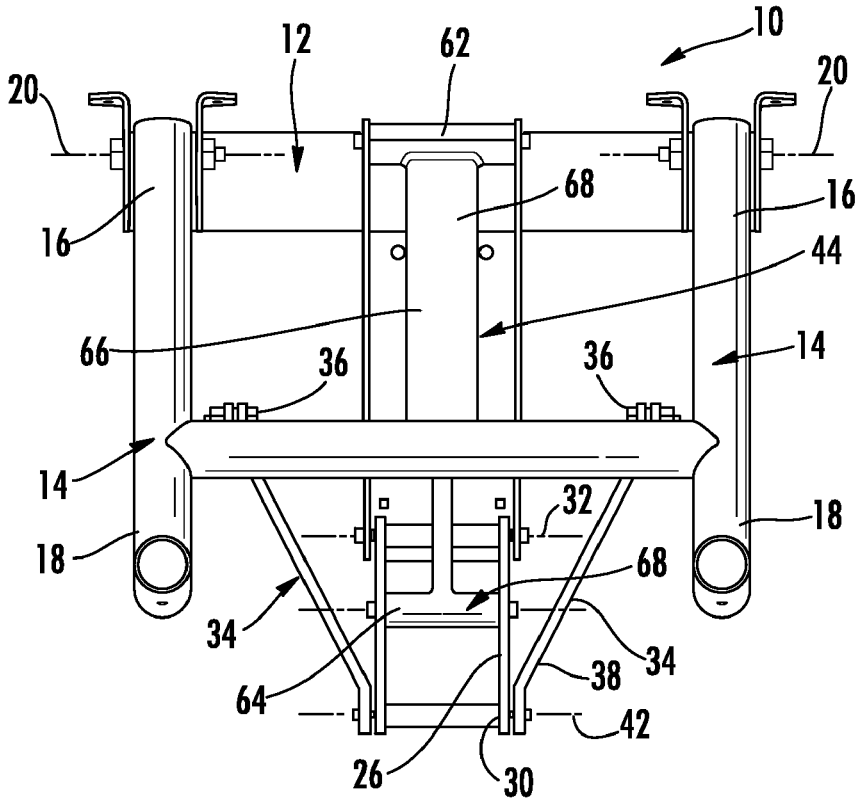
FIGS. 2 and 3 are front and top views, respectively, of the lifting apparatus of FIG. 1.
Figure 3:
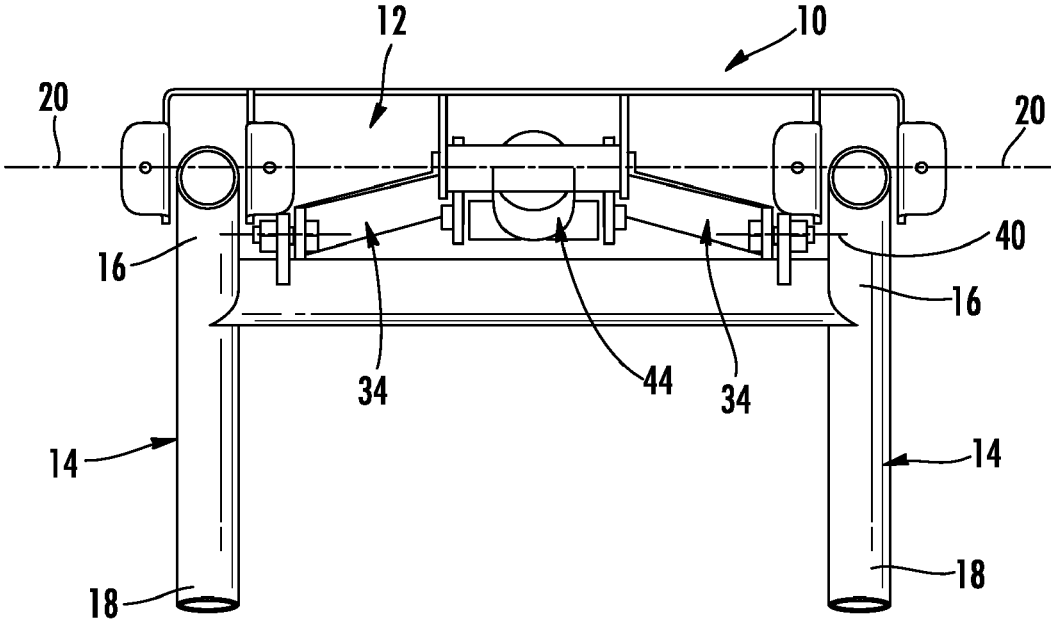
Figure 4:
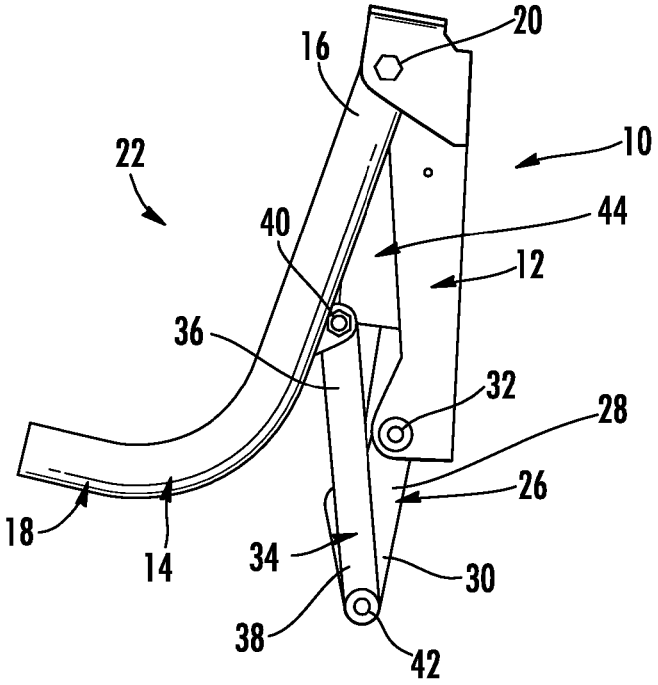
FIGS. 4 and 5 are partial side views illustrating the lifting apparatus of FIG. 1 is a lowered position and a raised position, respectively.
Figure 5:
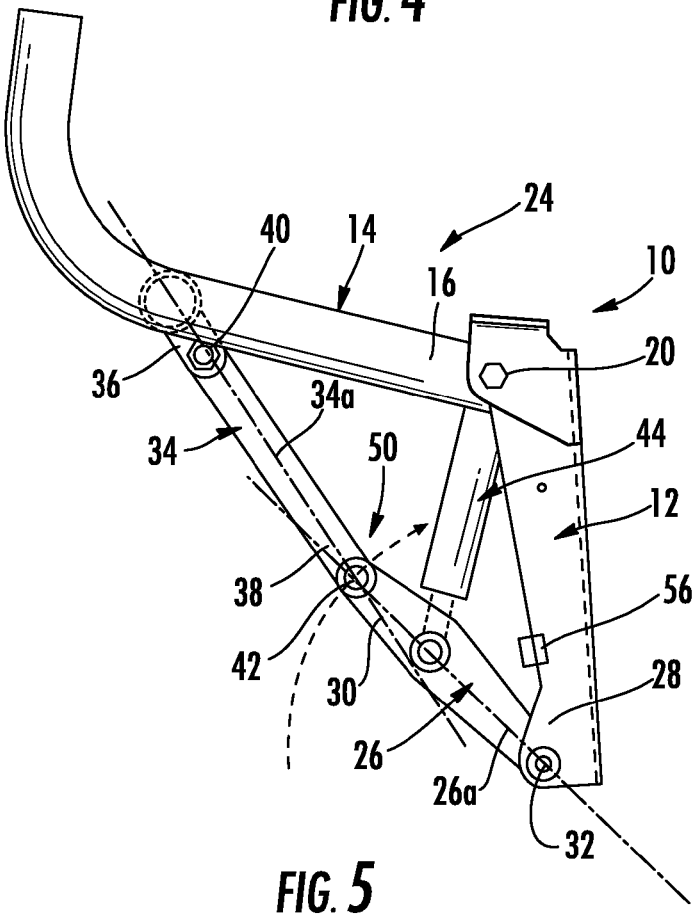

One embodiment of the present invention is illustrated with reference initially to FIGS. 1-3 illustrating, by way of example, a lifting apparatus 10 comprising a base 12. A lift arm 14 is herein described as having a proximal end 16 and a distal end 18. The proximal end 16 is pivotally attached to the base 12 for a generally vertical rotation of the lift arm 14 about a lift arm proximal pivot axis 20, wherein the lift arm distal end 18 and thus the apparatus 10 is moveable between a lowered position 22 and a raised position 24, as illustrated with reference to FIGS. 4 and 5, respectively. With continued reference to FIGS. 1-3, a crank arm 26 herein described as including a proximal end 28 and a distal end 30 has its proximal end 28 pivotally attached to the base 12 for rotation of the crank arm 26 about a crank arm proximal pivot axis 32. A connector arm 34 herein described as including a proximal end 36 and a distal end 38 has its proximal end 36 pivotally attached to the lift arm 14 for rotation of the connector arm 34 about a connector arm proximal pivot axis 40. The distal end 38 of the connector arm 34 is pivotally attached to the distal end 30 of the crank arm 26 for rotation about a common connector arm to crank arm distal pivot axis 42. For the embodiment herein described by way of example, an actuator 44 is pivotally connected between the base 12 and the crank arm 26. However, it will be clear to those skilled in the art to connect the actuator 44 to alternate elements such as the connector arm 34 for imparting rotations movement of the arms 14, 26, 34, now having the benefit of the teachings of the present invention. For clarity and focus on invention, the above description makes reference to arms 14, 26, 34 for the apparatus 10, but as is clear, reference may be made to arm pairs as will be further described later in this section.

Figure 6:
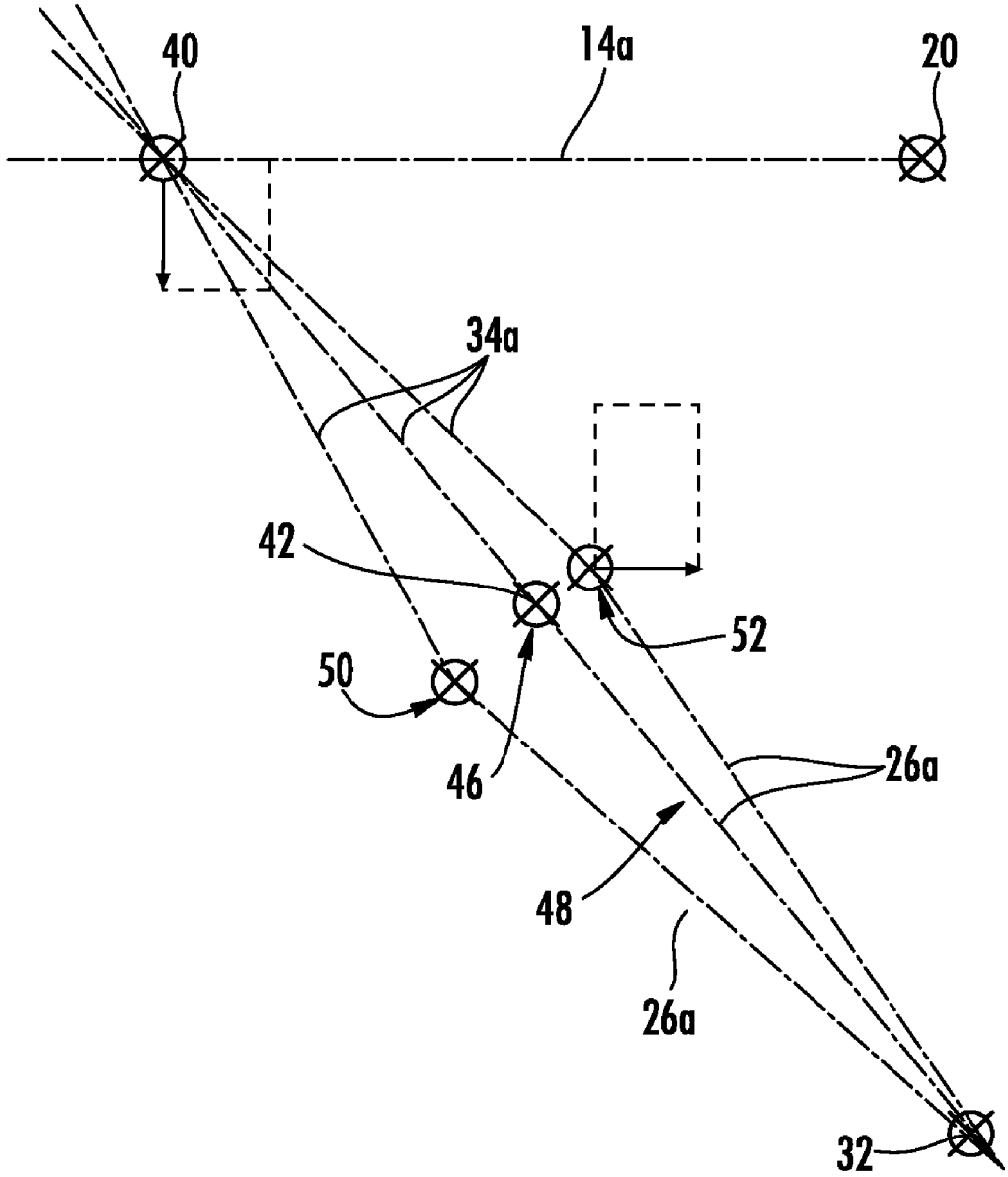
FIG. 6 is a diagrammatical illustration of linkage in a top dead center (TDC) and raised and lowered over center (OC) orientations, respectively.

With reference again to FIGS. 4 and 5, and to FIG. 6, the rotation of the connector arm 34 and the crank arm 26 are such that in combination, the connector arm 34 and the crank arm 26 are movable through a top dead center (TDC) alignment 46 having the common connector arm to crank arm distal pivot axis 42 in a straight line 48 alignment with both the connector arm proximal pivot axis 40 and the crank arm proximal pivot axis 32. With reference to FIG. 6, the crank arm 26 is illustrated using a crank arm longitudinal axis 26*a* and the connector arm 34 is illustrated using a connector arm longitudinal axis 34*a*. The lift arm 14 is diagrammatically illustrated using an effective lift arm axis 14*a*. The actuator 44 moves the crank arm 26 and the connector arm 34 from the top dead center alignment 46 to lowered over center alignments 50, illustrated with reference to FIGS. 5 and 6, with the lift arm 14 movable from the lowered position 22, illustrated with reference again to FIG. 4. By way of example, the lift arm 14 may be raised to the raised position 24, illustrated with reference again to FIG. 5, during operating positions of the apparatus 10 for raising and lowering the lift arm 14 for such events as lifting and lowering a dinghy as earlier described with reference to U.S. Pat. No. 7,293,521 and for raising and lowering a platform as will be described later in this section.

Figure 7:
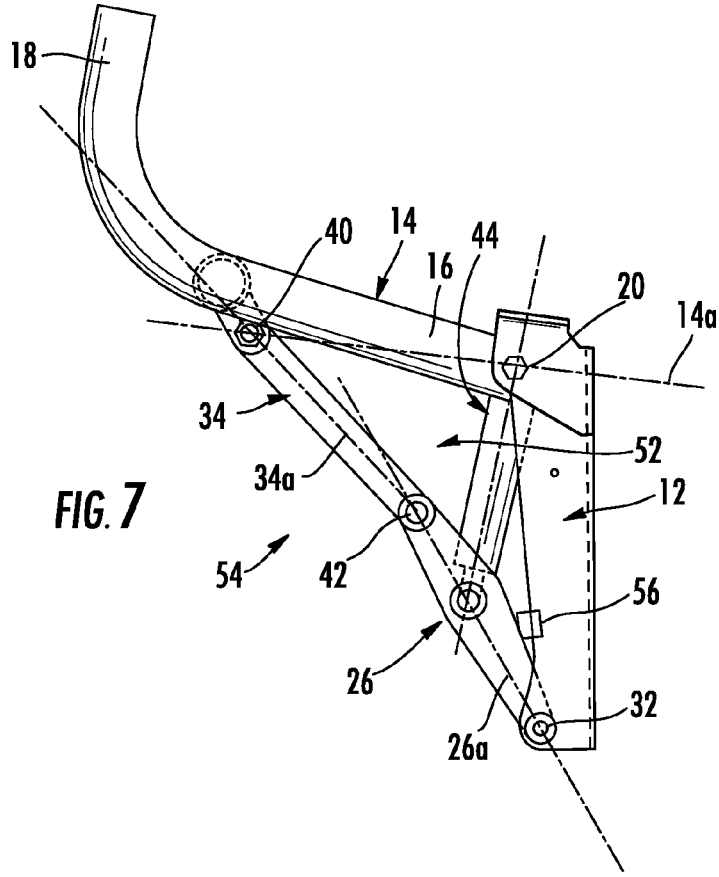
FIG. 7 is a side view of the embodiment of FIG. 1 illustrating linkage members in a locking position.

With reference again to FIG. 6 and now to FIG. 7, the apparatus 10 as herein described, may be raised to over center alignments, herein referred to as raised over center alignments 52 where there is a restricted and more limited movement of the lift arm 14 for setting the apparatus 10 in a locking position 54. With reference again to FIGS. 1 and 7, a stop 56 may be positioned for limiting a range of movement of the lift arm 14 during the raised over center alignment 52 of the connector arm 26 and the crank arm 26 positioned for receiving the crank arm there against. As later described, the actuator 44 may provide the stop 56.

Figure 8:
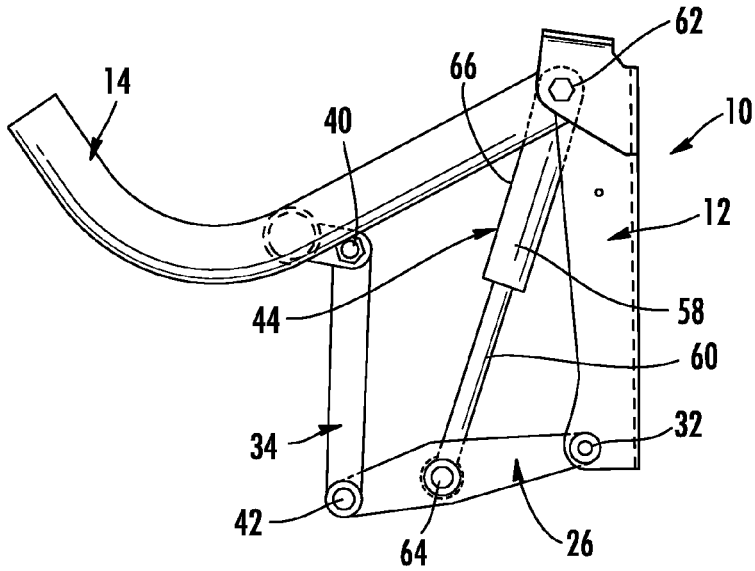
FIG. 8 is a partial side view of the apparatus of FIG. 1 illustrated in an intermediate lowered position.

For the embodiment herein described by way of example, and with reference again to FIGS. 1 and 2, and to FIG. 8, the actuator 44 comprises a housing 58 such as a cylinder, and a rod 60, such as a piston rod extendable into and out of the housing 58. The actuator 44 may comprise well known hydraulic, pneumatic, electric, or the like actuation to the rod 60. For the embodiment herein described by way of example, the housing 58 is pivotally connected to the base 12 at pivot point 62 and the rod 60 is pivotally connected to the crank arm 26 at pivot point 64. In one embodiment, an outside surface 66 of the housing 58 may provide the stop 56 earlier described for limiting the movement of the common connector arm to crank arm distal pivot axis 42 with the axis defined by axis assembly 68 contacting the housing 58 when in the raised over center alignment 52, thus limiting the movement of the lift arm 14 in the raised position in the locking position 54. As herein illustrated, only a single actuator 44 may be employed.

In operation, a user may operate the actuator for rotating the crank arm in a counter clockwise direction, wherein the counter clockwise rotation of the crank arm results in a lowering of the lift arm distal end to a lowered position of the lifting apparatus, and operate the actuator for rotating the crank arm in a clockwise direction, wherein the clockwise rotation of the crank arm results in a raising of the lift arm distal end to a raised position of the lifting apparatus. The crank arm may be rotated so as to rotate the crank arm and the connector arm in combination through a top dead center alignment, wherein a rotation axis of the pivot pin assembly, a common connector arm to crank arm distal pivot axis, is in a straight line alignment with both the connector arm proximal pivot axis and the crank arm proximal pivot axis, to a raised over center alignment in the raised position, wherein the raised over center alignment results in the pivot pin assembly hitting the stop and thus preventing further clockwise rotation of the crank arm for placing the apparatus in the locking position. Rotating the crank arm in a counter clockwise direction may move the apparatus from the over center position of the locking position through the top dead center alignment, wherein the rotation axis of the pivot pin assembly moves beyond the straight line alignment to a lowered over center alignment permits movement of the lift arm distal end to the lowered position.

Thus, when the connector arm longitudinal axis and the crank arm longitudinal axis are beyond a coincident alignment and on the cylinder side of the coincident alignment with the connector arm pivot axis skewed upward, the connector arm pivot axis rod is biased against the stop. As a result, under a force of gravity, the connector arm applies a force on the connector arm distal pivot axis resulting in the biasing force of the proximal pivot axis toward the cylinder. In this skewed orientation, there is no need to use the actuator to hold the lift arm and no need for a latch to secure the lift arm in the elevated dinghy storage position. The lift arm will remain in this locked position as a result of gravity alone. Such a "mechanical lock" is a safety feature accommodating, by way of example, an event including a hydraulic breach or failure of a related electrical system. The apparatus remains in a safe and stowed position until a positive action is initiated by a user.

Figure 9:
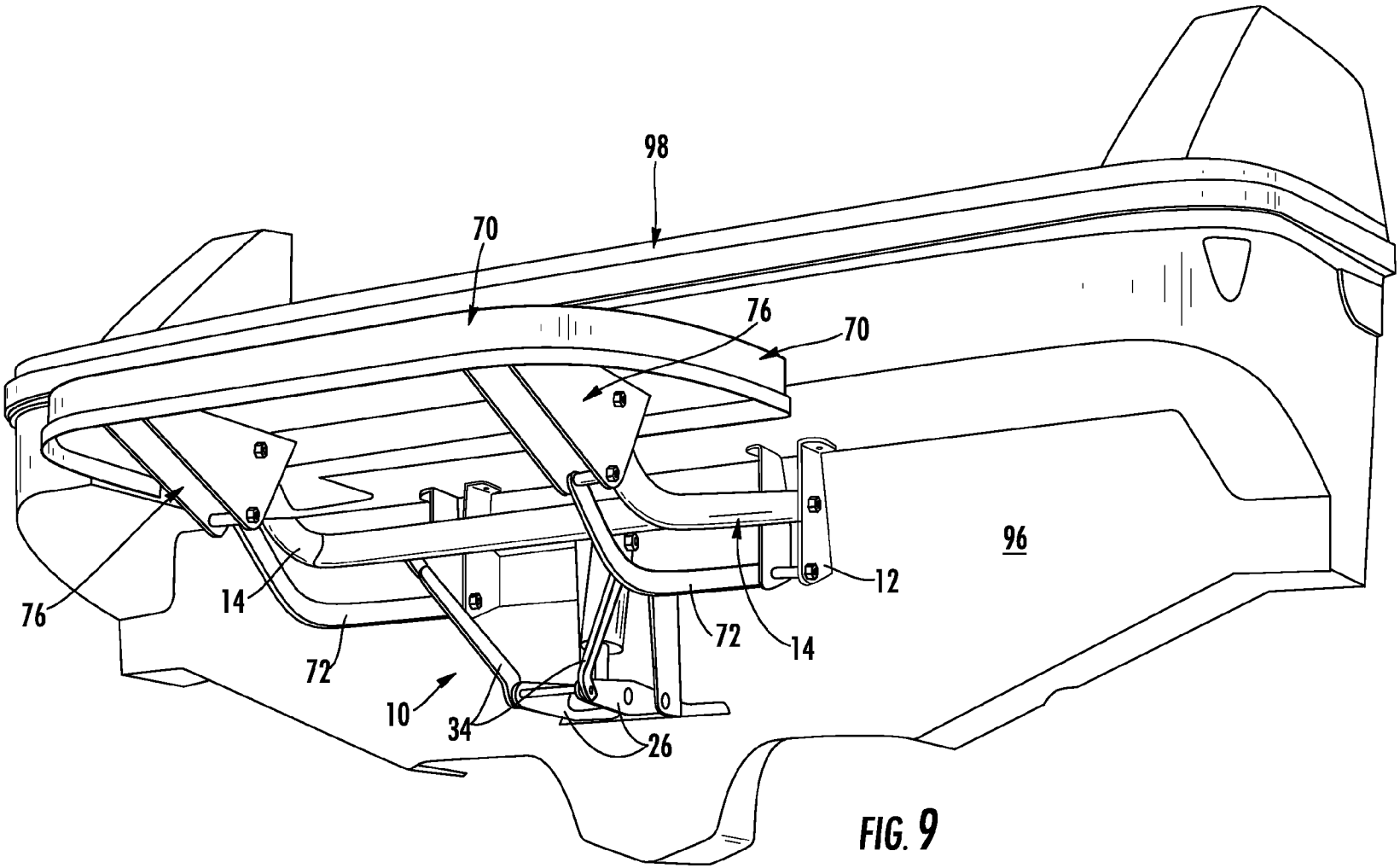
FIG. 9 is a perspective view of one embodiment of the invention including a platform carried by the lifting apparatus of FIG. 1.
Figure 10:
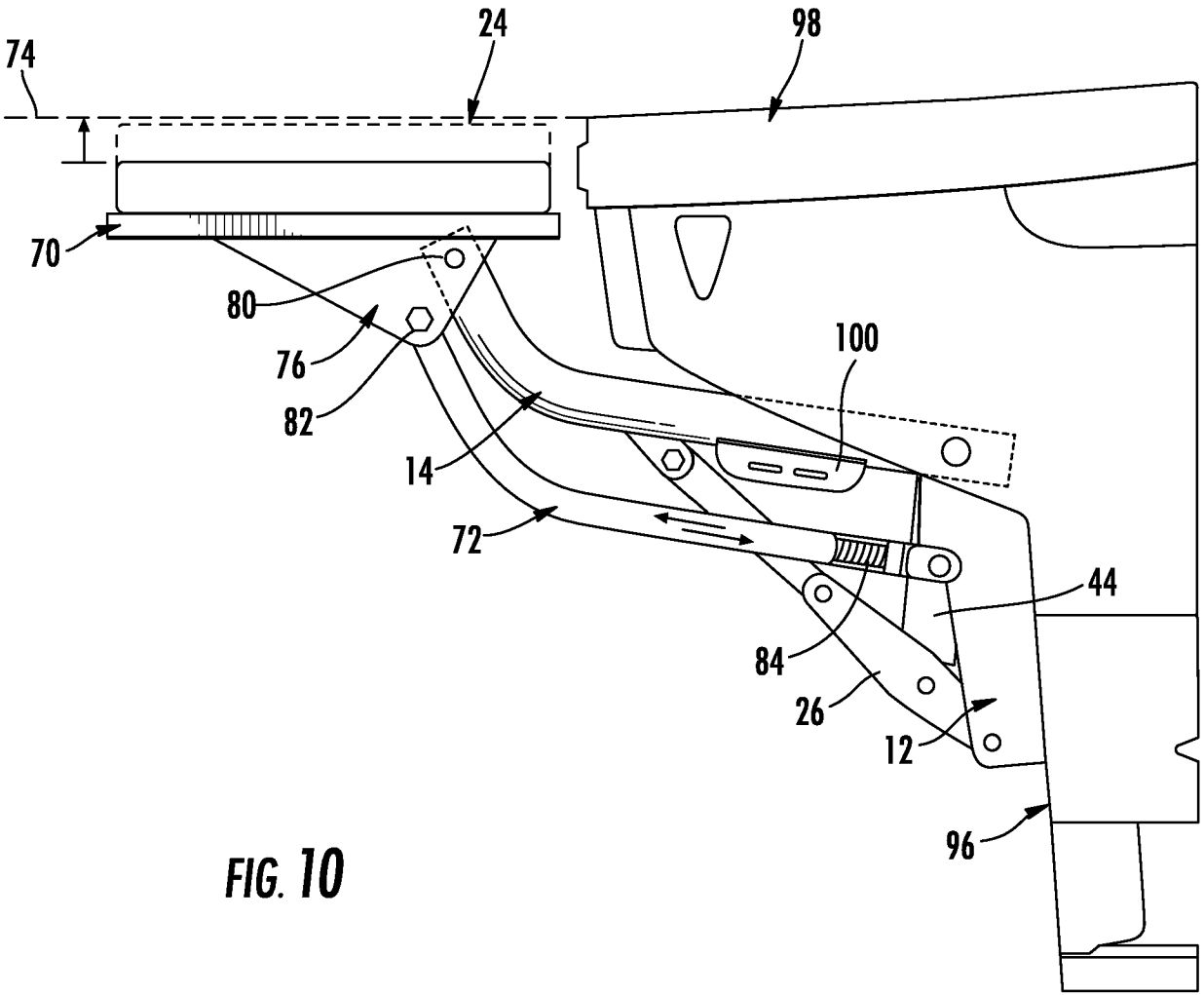
FIGS. 10 and 11 are partial side views illustrating raised and lowered positions of the platform.
Figure 11:
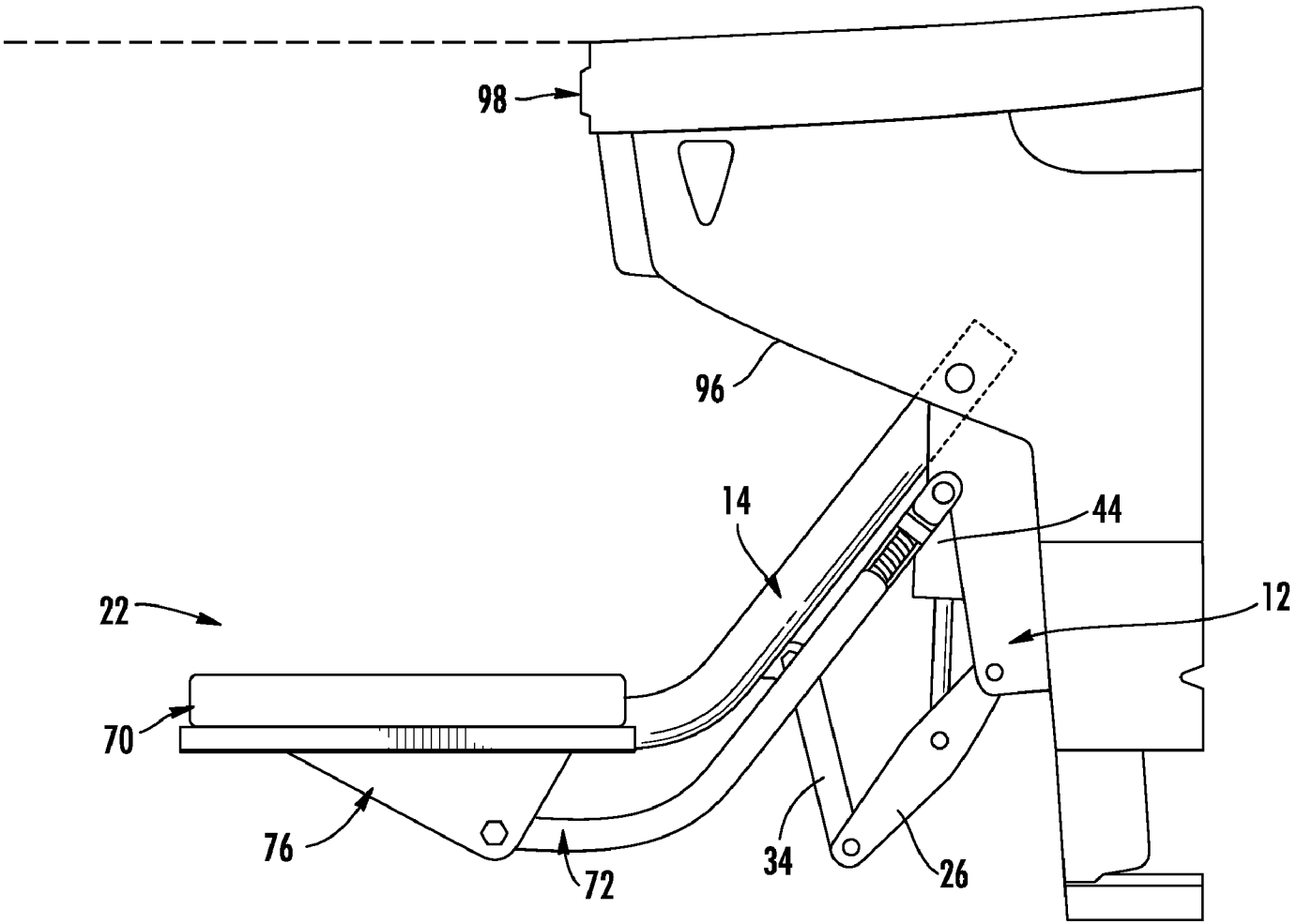

With reference now to FIGS. 9-11, one embodiment of the invention includes a platform 70 operable with the lifting apparatus 10 above described. The platform 70 is pivotally attached to the distal end 18 of the life arm 14. A leveling arm 72 is pivotally connected between the platform 70 and the base 12, wherein the leveling arm 72 and lift arm 14 in combination cause the platform 72 to be maintained in a generally horizontal orientation 74 during movement of the apparatus 10 between the raised position 24 and the lowered position 22 earlier described with reference to FIGS. 4 and 5, by way of example. For one embodiment of the invention as herein described, a platform support 76 is secured to a bottom surface 78 of the platform 70. As illustrated, the platform support 78 includes first and second pivot pins 80, 82 with the first pivot pin 80 proximate the platform bottom surface 78 and the second pivot pin 82 further distanced from the bottom surface 78 than the first pivot pin 80. The distal end 18 of the lift arm 14 is pivotally connected to the first pivot pin 80 and the leveling arm 72 is pivotally connected to the second pivot pin 82.

In one embodiment as illustrated with reference to FIG. 10, by way of example, an adjustment element 84 such as a threaded rod, is operable with the leveling arm 72 between the base 12 and the platform support 76 for modifying a length dimension of the leveling arm 72 and thus providing a leveling adjustment to the platform 70. A fine adjustment in the platform leveling may thus be achieved.

Figure 12:
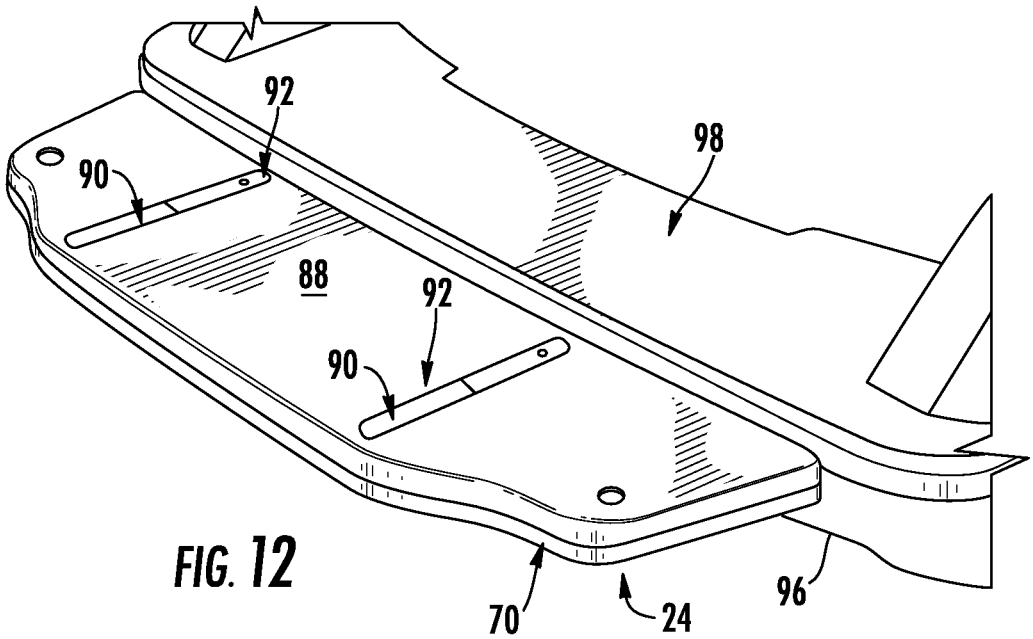
FIG. 12 illustrates an alternate embodiment of the invention, wherein the platform includes a chock assembly illustrated in a stowed position.
Figure 13:
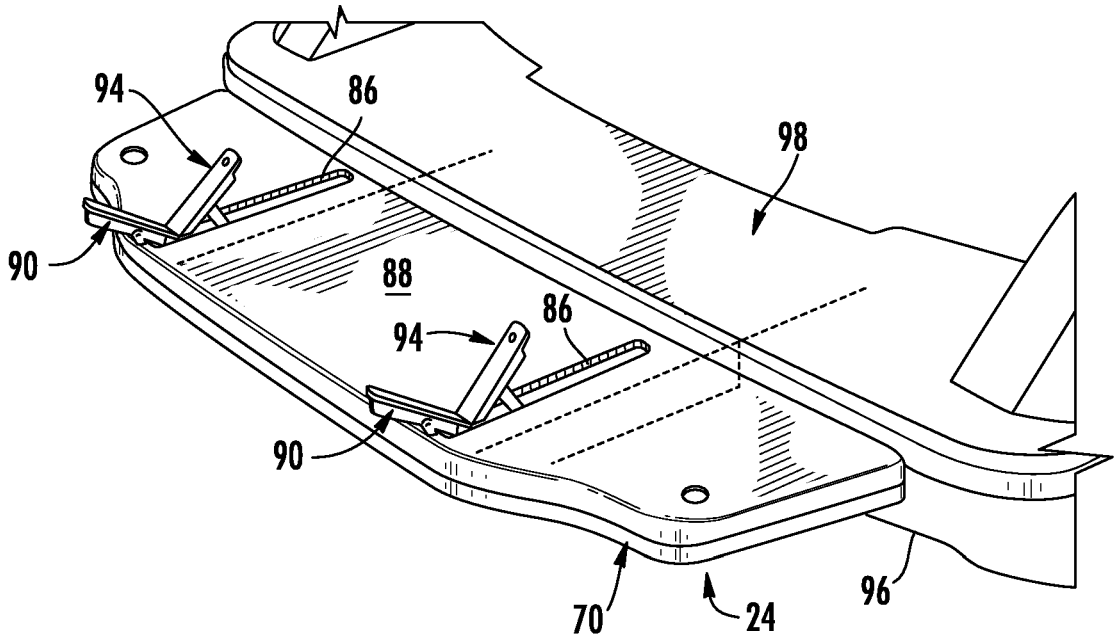
FIG. 13 illustrates the chock assembly of FIG. 12 in a deployed position.
Figure 14:
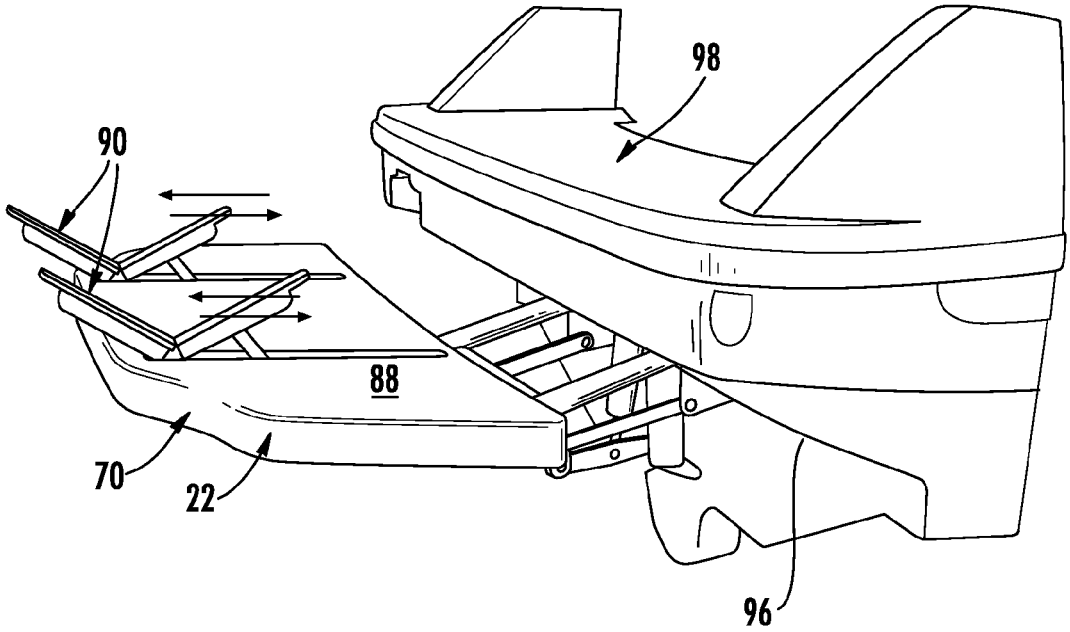
FIG. 14 illustrates the embodiment of FIG. 12 during a lifting position of the platform having the chock assembly in the deployed position.

As illustrated with reference to FIGS. 12-14, one embodiment may comprise the platform 70 having a cavity 86 accessible from a top surface 88 of the platform 70. A chock assembly 90 is foldable into the cavity 86 during a stowed position 92, as illustrated with reference to FIG. 12, and out of the cavity 86 into a deployed position 94, as illustrated with reference to FIG. 13. As herein illustrated by way of example, two cavities 86 and chock assemblies 90 will typically be employed.

The embodiment herein described, by way of example, while reference is made to single elements, includes lift arm pairs forming pivotally attached to a base plate. As illustrated with reference to FIGS. 9-11, the base 12 may be mounted to a transom 96 of a boat 98 or supporting structure such as a dock.

As a result of the above described apparatus 10, one of skill in the art will appreciate that pressure in lines feeding a pneumatic or hydraulic actuator, or power to an electric actuator, may be released allowing the lifting apparatus 10 and thus the platform 70 or dinghy being carried by the chock assemble 90 to be held in a stored position, the locking position 54 without concern. When it is time to lower the platform 70, pressure is provided to the actuator 44 for moving the piston rod 60 outward and driving the crank arm 26 for lowering the lift arm 14.

Depending upon a need, strengthening of the lift arm 14 or other structural supports may be improved using various selected materials and/or gussets, by way of example, and as illustrated with reference again to FIG. 10. Consistent with the embodiment illustrated and as above described, the lift arm 14 comprises a lift arm pair having proximal ends pivotally attached to the base 12, the crank arm 26 comprises a crank arm pair having proximal ends pivotally attached to the base 12, and the connector arm 34 comprises a connector arm pair having proximal ends pivotally attached to the lift arm pair for rotation about a connector arm proximal pivot pin, and distal ends pivotally attached to the distal ends of the crank arm pair for rotation about a common connector arm to crank arm distal pivot pin. Additional strength may be obtained in such a structure by a cross beam 102, illustrated by way of example with reference again to FIGS. 1-3, wherein the cross beam 102 provides a rigid connection between the lift arms 14 of the lift arm pair.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the claims supported by this disclosure.

The invention claimed is:

1. A lifting apparatus comprising:

a base;

a lift arm having a proximal end and a distal end, the proximal end pivotally attached to the base for a rotation of the lift arm about a lift arm proximal pivot axis, wherein the lift arm distal end is moveable between a lowered position and a raised position;

a crank arm having a proximal end and a distal end, the proximal end pivotally attached to the base for rotation of the crank arm about a crank arm proximal pivot axis;

a connector arm having a proximal end and a distal end, the proximal end pivotally attached to the lift arm for rotation about a connector arm proximal pivot axis, and the distal end pivotally attached to the distal end of the crank arm for rotation about a common connector arm to crank arm distal pivot axis; and an actuator operable with at least one of the crank arm and the connector arm for rotational movement thereof, wherein the actuator comprises a housing and a rod extendable into and out of the housing through at least one of hydraulic, pneumatic, and electric actuation of the rod, and wherein a housing and rod combination is pivotally connected between the base and at least one of the crank arm and the connector arm.

2. An apparatus according to claim 1, wherein the rotation of the connector arm and the crank arm are such that in combination the connector arm and the crank arm are movable from a top dead center alignment having the common connector arm to crank arm distal pivot axis in a straight line alignment with both the connector arm proximal pivot axis and the crank arm proximal pivot axis, and wherein the actuator causes movement of the crank arm and the connector arm from the top dead center alignment to lowered over center alignments with the lift arm movable from the lowered position to the raised position during operating positions of the apparatus, to raised over center alignments with limited movement of the lift arm in the raised position during a locking position of the apparatus.

3. An apparatus according to claim 2, further comprising a stop positioned for limiting a range of movement of the lift arm during the raised over center alignment of the connector arm and the crank arm.

4. An apparatus according to claim 3, wherein the actuator comprises a housing and a rod extendable into and out of the housing through at least one of hydraulic, pneumatic, and electric actuation of the rod, wherein a housing and rod combination is pivotally connected between the at least one of the crank arm and the connector arm, and wherein the housing provides the stop by limiting the movement of the common connector arm to crank arm distal pivot axis when in the raised over center alignment, thus limiting the movement of the lift arm in the raised position in the locking position.

5. An apparatus according to claim 1, wherein the actuator comprises a single actuator connected to the crank arm.

6. An apparatus according to claim 1, wherein the rod is pivotally connected to the crank arm at a pivot axis positioned between the proximal and distal ends thereof.

7. An apparatus according to claim 1, further comprising:

a platform pivotally attached to the distal end of the lift arm; and a leveling arm pivotally connected between the platform and the base, wherein the leveling arm and lift arm in combination cause the platform to be maintained in a generally horizontal orientation during movement of the lift arm between the raised and lowered positions.

8. An apparatus according to claim 7, further comprising a platform support secured to a bottom surface of the platform, the platform support having first and second pivot pins with the first pivot pin proximate the platform bottom surface and the second pivot pin further distanced from the bottom surface than the first pivot pin, wherein the distal end of the lift arm is pivotally connected to the first pivot pin and the leveling arm is pivotally connected to the second pivot pin.

9. An apparatus according to claim 8, further comprising an adjustment element operable with the leveling arm between at least one of the base and platform support, the adjustment element operable for modifying a length dimension of the leveling arm and thus providing a leveling adjustment to the platform.

10. An apparatus according to claim 7, wherein the platform comprises a cavity accessible from a top surface of the platform, the apparatus further comprising a chock assembly foldable into a cavity during a stowed position and out of the cavity into a deployed position for carrying a small water craft.

11. A lifting apparatus comprising:

a base;

a lift arm having a proximal end and a distal end, the proximal end pivotally attached to the base for a generally vertical rotation of the lift arm about a lift arm proximal pivot axis, wherein the lift arm distal end is moveable between a lowered position and a raised position;

a crank arm having a proximal end and a distal end, the proximal end pivotally attached to the base for a generally vertical rotation of the crank arm about a crank arm proximal pivot axis;

a connector arm having a proximal end and a distal end, the proximal end pivotally attached to the lift arm for rotation about a connector arm proximal pivot axis, and the distal end pivotally attached to the distal end of the crank arm for rotation about a common connector arm to crank arm distal pivot axis, wherein the rotation of the connector arm and the crank arm are such that in combination the connector arm and the crank arm are movable from a top dead center alignment having the common connector arm to crank arm distal pivot axis in a straight line alignment with both the connector arm proximal pivot axis and the crank arm proximal pivot axis, and wherein the actuator causes movement of the crank arm and the connector arm from the top dead center alignment to lowered over center alignments with the lift arm movable from the lowered position to the raised position during operating positions of the apparatus, to raised over center alignments with limited movement of the lift arm in the raised position during a locking position of the apparatus; and an actuator operable with at least one of the crank arm and the connector arm for providing a rotational movement thereto.

12. An apparatus according to claim 11, further comprising a stop positioned for limiting a range of movement of the lift arm during the raised over center alignment of the connector arm and the crank arm.

13. An apparatus according to claim 12, wherein the actuator comprises a housing and a rod extendable into and out of the housing through at least one of hydraulic, pneumatic, and electric actuation of the rod, wherein a housing and rod combination is pivotally connected between the base and the at least one of the crank arm and the connector arm.

14. An apparatus according to claim 13, wherein the stop comprises the housing, and wherein a pin assembly forming the common connector arm to crank arm distal pivot axis contacts the housing when the apparatus is in the raised over center alignment position, thus placing the lift arm in the locking position.

15. An apparatus according to claim 11, wherein the lift arm comprises a lift arm pair having proximal ends pivotally attached to the base, the crank arm comprises a crank arm pair having proximal ends pivotally attached to the base, and the connector arm comprises a connector arm pair having proximal ends pivotally attached to the lift arm pair for rotation about a connector arm proximal pivot pin, and distal ends pivotally attached to the distal ends of the crank arm pair for rotation about a common connector arm to crank arm distal pivot pin.

16. An apparatus according to claim 15, wherein the lift arm pair comprises first and second lift arms connected by a cross beam, the cross beam providing a rigid connection between the first and second lift arms.

17. An apparatus according to claim 16, further comprising a gusset affixed to each of the first and second lift arms.

18. An apparatus according to claim 15, further comprising:

a platform pivotally attached to the distal end of the lift arm pair; and first and second leveling arms pivotally connected between the platform and the base, wherein the leveling arms and lift arm pair in combination cause the platform to be maintained in a generally horizontal orientation during movement of the lift arm between the raised and lowered positions.

19. A method of operating a lifting apparatus for raising and lowering a platform, wherein the lifting apparatus includes a lift arm having a proximal end pivotally attached to a base for a generally vertical rotation of the lift arm about a lift arm pivot axis for moving a lift arm distal end between a lowered position and a raised position, the lifting apparatus further comprising a crank arm having a proximal end pivotally attached to the base and a connector arm having a proximal end pivotally attached to the lift arm and a distal end pivotally attached to a distal end of the crank arm for rotation about a common connector arm to crank arm pivot pin assembly, and wherein an actuator is operable with the crank arm or the connector arm for rotation thereof, the method comprising:

operating the actuator for rotating the crank arm in a counter clockwise direction, wherein the counter clockwise rotation of the crank arm results in a lowering of the lift arm distal end to a lowered position of the lifting apparatus; and operating the actuator for rotating the crank arm in a clockwise direction, wherein the clockwise rotation of the crank arm results in a raising of the lift arm distal end to a raised position of the lifting apparatus; and rotating the crank arm and the connector arm in combination through a top dead center alignment, wherein a rotation axis of the pivot pin assembly, a common connector arm to crank arm distal pivot axis, is in a straight line alignment with both the connector arm proximal pivot axis and the crank arm proximal pivot axis, to a raised over center alignment in the raised position, wherein the raised over center alignment results in the pivot pin assembly hitting a stop and thus preventing further clockwise rotation of the crank arm and thus providing a locking position of the apparatus.

20. A method according to claim 19, further comprising:

rotating the crank arm in a counter clockwise direction for moving the apparatus from the over center position of the locking position through the top dead center alignment, wherein the rotation axis of the pivot pin assembly moves beyond the straight line alignment to a lowered over center alignment permits movement of the lift arm distal end to the lowered position.

21. A method according to claim 19, wherein the actuator comprises a housing and a rod extendable into and out of the housing through at least one of hydraulic, pneumatic, and electric actuation of the rod, and wherein the housing is pivotally connected to the base and the rod is pivotally connected the crank arm, the crank arm rotating comprising:

extending the rod from the housing for rotating the crank arm in the counter clockwise direction; and retracting the rod into the housing for rotating the crank arm in the clockwise direction.

22. A method according to claim 19, wherein the lifting apparatus is affixed to a boat, the lifting apparatus including a platform pivotally attached to the lift arm distal end and a leveling arm pivotally connected between the platform and the base, wherein the leveling arm and lift arm in combination cause the platform to be maintained in a generally horizontal orientation during movement of the lift arm between the raised and lowered positions, the leveling arm including an adjustment element operable with the leveling arm between at least one of the base and platform support, the method further comprising:

rotating the lift arm for positioning the platform proximate a deck of the boat;

adjusting the adjustment element for modifying a length dimension of the leveling arm and thus modifying a horizontal orientation of a surface of the platform;

continuing the adjusting to a desired leveling of the platform with the deck.

23. A method according to claim 19, wherein the lifting apparatus is affixed to a boat, the lifting apparatus including a platform pivotally attached to the lift arm distal end, and wherein the platform includes an elongate cavity extending fore and aft the platform, the cavity accessible from a top surface of the platform and a chock assembly foldable into a cavity during a stowed position and out of the cavity into a deployed position for carrying a small water craft, the method comprising:

positioning the lifting apparatus in the raised position;

moving the chock assembly from the stowed position to the deployed position;

lowering the lift apparatus and thus the platform to the lowered position;

placing a small water vessel onto the chock assembly; and raising the lift assembly to the raised position.

* * * * *